United States Patent [19]

Toy et al.

[11] 3,969,814

[45] July 20, 1976

[54] METHOD OF FABRICATING WAVEGUIDE STRUCTURES

[75] Inventors: Albert Toy, Gardena; Paul T. Nelson, Rolling Hills Estates; Clarence E. Schafer, Costa Mesa, all of Calif.

[73] Assignee: TRW Inc., Redondo Beach, Calif.

[22] Filed: Jan. 15, 1975

[21] Appl. No.: 541,169

[52] U.S. Cl. ..... 29/600; 427/105

[51] Int. Cl.[2] ..... H01P 11/00

[58] Field of Search ..... 29/600, 423, 527.1, 29/527.2, 601; 333/95 R, 96, 97 R, 98 R, 84 R, 31 A, 31 R; 427/123, 105; 204/14 R, 25, 32 R

[56] References Cited

UNITED STATES PATENTS

| | | | |
|---|---|---|---|
| 2,724,660 | 11/1955 | Ingalls et al. | 427/105 |
| 2,826,524 | 3/1958 | Molloy | 333/95 X |
| 3,247,579 | 4/1966 | Cattermole et al. | 29/600 X |
| 3,372,471 | 3/1968 | Kuhn | 29/600 |
| 3,697,898 | 10/1972 | Blachier et al. | 333/21 A |
| 3,713,051 | 1/1973 | Kell | 333/73 R |

*Primary Examiner*—C.W. Lanham
*Assistant Examiner*—James R. Duzan
*Attorney, Agent, or Firm*—Daniel T. Anderson; Donald R. Nyhagen; Edwin A. Oser

[57] ABSTRACT

A waveguide structure is fabricated by plating a mandrel with a high electrical conductivity metal, such as copper; plasma spray coating the plated mandrel with a selected waveguide body material; forming coupling flanges about the plated mandrel at the ends of the plasma spray formed layer; and removing the mandrel in such a way that the plated metal and plasma spray formed layers remain intact to form a tubular waveguide body with an inner high conductivity liner. The waveguide structure described is a plural cavity bandpass waveguide filter which is fabricated on a mandrel comprising separable sections arranged end to end. Plated iris discs are clamped between the confronting ends of the mandrel sections prior to metal plating plasma spray coating of the mandrel, such that when the mandrel is removed, the iris discs remain intact with and peripherally joined to the filter body liner to define the resonant filter cavities. The invention permits fabrication of lightweight and dimensionally stable high precision waveguide structures from low thermal expansion material which are difficult or impossible to fabricate into such structures by known fabrication techniques.

14 Claims, 2 Drawing Figures

METHOD OF FABRICATING WAVEGUIDE STRUCTURES

BACKGROUND OF THE INVENTION

1. Field of the Invention:

This invention relates generally to waveguide structures such as simple waveguides, waveguide filters, and the like. The invention relates more particularly to a novel method of fabricating such structures.

Prior Art:

As will appear from the ensuing description, the fabrication method of the invention may be utilized to fabricate a variety of waveguide structures. However, the method is particularly suited to fabricating lightweight, high precision waveguide structures having a high degree of dimensional stability in a thermal environment whose temperature fluctuates over a relatively wide range, that is extremely small, if not virtually zero, dimensional change in response to the temperature fluctuations. Accordingly, the invention will be described in this particular context.

One example of a waveguide structure which is required to be fabricated with great precision and to possess a high degree of dimensional stability is that described in U.S. Pat. No. 3,697,898. This patented waveguide structure is a plural cavity bandpass microwave filter having a tubular body and reflection iris discs within the filter passage at positions spaced there along. These iris discs form therebetween resonant cavities which are coupled to one another and to the waveguides leading to and from the filter through iris openings in the discs. Threaded in the filter body between the iris discs are tuning screws which project into the resonant cavities and are adjustable into and from the cavities to tune the filter. Coupling flanges are provided at the ends of the filter body for joining the filter to the waveguides leading to and from the filter.

The operating principle of this filter is fully explained in the patent and hence need not be elaborated on in this disclosure. Suffice it to say that proper operation of the filter requires precise dimensioning of the filter cavities and high dimensional stability of the filter structure such that the cavity dimensions remain unchanged even though the filter structure is exposed to widely fluctuating temperatures. Such dimensional stability, in turn, requires fabrication of the filter body from a material having a very low and preferably virtually zero coefficient of thermal expansion. Light weight is another critical requirement of many waveguide structures.

A variety of materials exist which possess a sufficiently low coefficient of thermal expansion to satisfy the stringent thermal stability requirements of the patented plural cavity bandpass waveguide filter and other high precision waveguide structures. Examples of such low thermal expansion materials are various INVAR and KOVAR compositions such as Fe-35Ni, 54Fe-28NI-18Co, and 37Fe-30NI-25Co-8Cr; cermet and ceramics/metal composites such as Ni-60$Al_2O_3$ and Al-20$Al_2O_3$; ceramic or metal filler reinforced plastic materials wherein the filler components may be chopped fibers, whiskers, or powders of carbon/graphite, $Al_2O_3$, $ZrO_2$, fused silica, or INVAR, and the matrix may be epoxy, phenolic or other polymeric materials functioning as a binder.

While such low thermal expansion materials exist, each presents problems in connection with waveguide fabrication. From the standpoint of its thermal expansion and mechanical strength, for example, INVAR is ideal for a waveguide body. INVAR, however, is difficult or impossible to fabricate into a lightweight waveguide structure by conventional techniques, such as machining, electroforming, and the like. Other problems which are confronted in waveguide fabrication are application of a conductive liner to the interior surface of the body and, in the case of a waveguide filter, installation of irises within the waveguide filter body. In this regard, attention is direction to U.S. Pat. Nos.:

| | | |
|---|---|---|
| 2,826,524 | 3,247,579 | 3,536,800 |
| 2,870,524 | 3,299,492 | 3,540,119 |
| 3,070,873 | 3,314,130 | 3,548,345 |
| 3,195,079 | 3,372,471 | |

which illustrate various waveguide structures and methods of waveguide fabrication. This invention obviates these and other problems associated with fabrication of waveguide structures from materials of the class described.

SUMMARY OF THE INVENTION

According to one aspect of the invention, a simple waveguide structure is fabricated by preparing a smooth surfaced mandrel having a cross-section conforming to the desired cross-section of the waveguide passage; plating the mandrel with a metal of high electrical conductivity; plasma spray coating the plated mandrel with a selected waveguide body material; and removing the mandrel in such a way that the plasma spray formed and plated metal layers remain intact to form, respectively, a hollow shell-like waveguide body and an electrically conductive liner within the body having a smooth inner surface conforming to the mandrel surface. Removal of the mandrel may be accomplished in various ways, as by selectively etching the mandrel away with a chemical agent or constructing the mandrel of a low melting point material such as zinc or wax and melting the mandrel.

The particular waveguide structure described is a plural cavity bandpass waveguide filter similar to that described in the earlier mentioned U.S. Pat. No. 3,697,898. This filter is fabricated by the basic waveguide fabrication technique of the invention utilizing a mandrel which is divided transversely into separable sections coaxially arranged end to end. An apertured iris disc, plated with the same high conductivity metal as that used on the mandrel, is placed between the confronting ends of each pair of adjacent mandrel sections after which the sections and the exposed edges of the iris discs are metal plated and plasma spray coated, as described above. Thereafter, the mandrel sections are removed by selective etching, melting or other method which leaves the iris discs intact with the plasma spray formed body and plated metal conductive liner of the filter to form the resonant filter cavities between the discs. The metal plating on the iris discs is integrally joined to the liner about the full periphery of each disc to provide electrical continuity between the liner and discs.

According to another feature of the invention, the mandrel sections between the iris discs are provided with radially projecting threaded studs which are metal plated, plasma spray coated, and then removed with the sections to form in the filter body plated threaded holes to receive tuning screws. Further features of the invention involve the formation of coupling flanges on the ends of the filter body and machining of the body to provide a lightweight finished waveguide filter structure.

A primary advantage of the invention is that it permits the fabrication of lightweight, high precision, dimensionally stable waveguide filters and other waveguide structures from low thermal expansion materials, such as those mentioned earlier, which are difficult or impossible to fabricate into such structures by known fabrication techniques.

DESCRIPTION OF THE PREFERRED EMBODIMENTS

Figure 1:
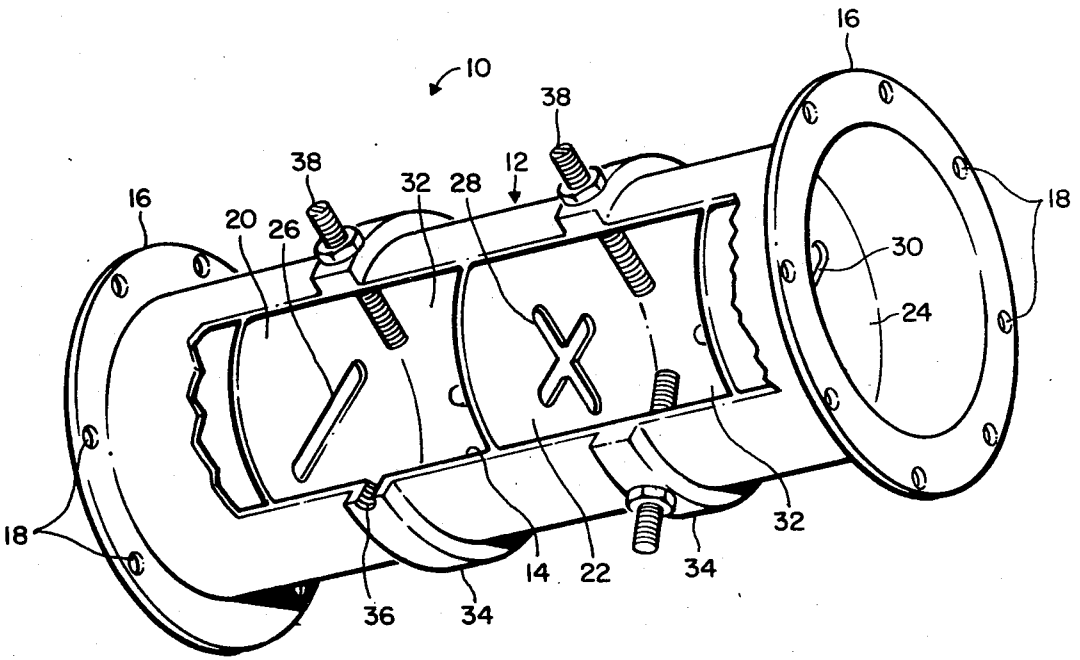
FIG. 1 is a perspective view, partly broken away, of a waveguide structure, in this instance a plural cavity bandpass waveguide filter, fabricated in accordance with the invention.

Turning first to FIG. 1, the illustrated waveguide structure or filter 10 is similar to the plural cavity bandpass waveguide filter described in the earlier mentioned U.S. Pat. No. 3,697,898. This filter has a tubular body 12 of cylindrical cross-section with an inner electrically conductive liner 14 and end coupling flanges 16 having holes 18 for coupling bolts. This structure of the filter constitutes essentially a waveguide having a passage extending axially through the body. Extending across this passage, in transverse planes spaced along the passage, are three iris discs 20, 22, and 24 having iris openings 26, 28, and 30. These discs form resonant cavities 32 between the adjacent discs. About the outside of the filter body 12, approximately midway between the ends of the cavities 32 are enlarged reinforcing ribs 34 containing threaded openings 36 for tuning screws 38.

The operation of the filter 10 is identical to that described in the above mentioned patent, and, moreover, this invention is concerned with the fabrication of the filter, not its physical construction as such nor its operation. Accordingly, there is no need to elaborate further on the filter construction or operation.

Figure 2:
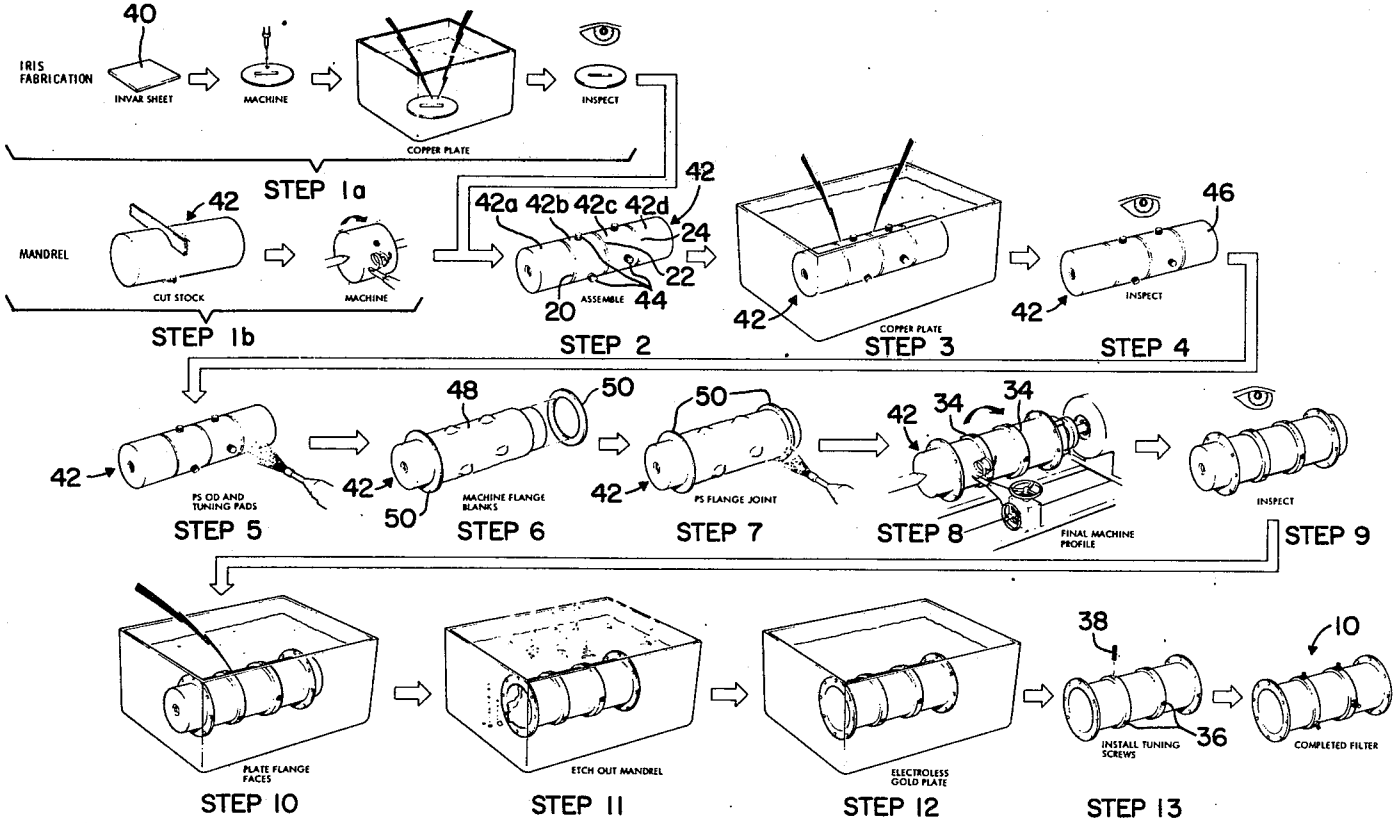
FIG. 2 illustrates the successive steps involved in fabricating the filter of FIG. 1 according to the present invention.

Reference is now made to FIG. 2 illustrating the successive steps which are involved in fabricating the filter 10 according to this invention. The present filter fabrication technique involves two initial steps depicted in FIG. 2 as steps 1*a* and 1*b*. Step 1*a* involves fabrication of the iris discs 20, 22, and 24 from smooth surfaced or polished blanks 40 which are machined to the internal cross-section of the filter body 12 and apertured to provide the iris openings 26, 28, and 30 and then plated with a metal of relatively high conductivity, such as copper. Step 1*b* involves preparation of a mandrel whose cross-section conforms to the internal cross-section of the filter body. This mandrel is divided into four separable sections 42*a*, 42*b*, 42*c*, and 42*d* along transverse parting planes normal to the mandrel axis. The surfaces of the mandrel sections are machined, polished, or otherwise processed to a highly smooth surface finish. After the mandrel sections have thus been prepared, threaded studs 44 are inserted into the two inner mandrel sections 42*b*, 42*c* with the studs projecting radially beyond the mandrel surfaces and spaced circumferentially about the sections, in the manner explained later.

The iris discs 20, 22, and 24, and the mandrel sections 42*a*, 42*b*, 42*c*, and 42*d* are next assembled in the manner depicted in step 2 of FIG. 2. In the mandrel-disc assembly, the center iris 22 is positioned between the confronting ends of the two center mandrel sections 42*b* and 42*c*. Iris disc 20 is positioned between the confronting ends of mandrel sections 42*a* and 42*b*, and iris disc 24 is positioned between the confronting ends of mandrel sections 42*c* and 42*d*. The mandrel sections and iris discs are retained in coaxial assembled relation with the discs firmly clamped between the mandrel sections in any convenient way, as by means of a clamp straddling the mandrel endwise and engaging the mandrel ends.

The third step of the present filter fabricating method involves plating the assembly of iris discs 20, 22, and 24, and the mandrel sections 42*a*, 42*b*, 42*c*, and 42 d 42*with a metal of relatively high electrical conductivity which is preferably the same metal as used in the iris disc plating operation of step 1a*, namely copper. This may be accomplished by electroplating the assembly in a plating solution as depicted in step 3 of FIG. 2. The plating operation of step 3 forms on the mandrel sections and the exposed edges of the iris discs a thin and uniform layer 46 of the high conductivity metal whose inner surface conforms to the smooth surfaces of the mandrel sections and is integrally bonded to the edges of the iris discs and to the metal plating layers on the discs.

Following metal plating of the mandrel-iris disc assembly and subsequent inspection of the plated assembly to assure a proper metal plate has been applied, as depicted in step 4 of FIG. 2, the plated assembly is plasma spray coated with a selected filter body material, as shown in step 5 of FIG. 2. This operation forms a relatively thick layer 48 of the body material over the plated metal layer. It is significant to recall here that an objective of the invention is to form high precision, lightweight, dimensionally stable waveguide filters and other waveguide structures and that an advantage of the invention resides in the fact that it permits fabrication of such waveguide structures from the low thermal expansion materials mentioned earlier which are difficult or impossible to fabricate into waveguide structures by the presently known methods of fabrication. According to the preferred practice of the invention, therefore, when fabricating the illustrated waveguide filter, the waveguide body material which is plasma spray coated on the mandrel is selected from the earlier list of low expansion materials. INVAR is the preferred body material. It will be understood by those versed in the art, of course, that the above mentioned advantage of the invention stems from the fact that virtually any material, including all of those listed may be plasma spray without difficulty on any shape mandrel.

The next steps of the present filter fabrication method involve the formation of the coupling flanges 16. This may be accomplished in various ways. In steps 6 and 7 of FIG. 2, the flanges are formed by preparing flange rings 50 which are sized to fit snugly over the ends of the plated mandrel 42 and placing these rings over the mandrel ends at the ends of the plasma spray coated layer 48 as shown in step 6. The rings are then joined to the layer 48 by plasma spraying the joint therebetween, as depicted in step 7.

In step 8 of the method, the outer surface of the plasma spray formed structure is machined to form the reinforcing ribs 34 in the planes of the mandrel studs 44 and smooth cylindrical wall portions between the reinforcing ribs and the coupling flanges. This machining operation provides the waveguide filter with its finished configuration and also reduces the weight of the filter. The outer cylindrical surfaces of the reinforcing ribs 34 are machined sufficiently to expose the studs 44. The machined structure is then inspected in step 9 and electroplated in step 10 to plate the axially presented seating faces of the coupling flanges 16 with copper.

At this point, the mandrel 42 and its threaded studs 44 are removed in such a way that the plated metal layer 46, plasma spray formed layer 48, coupling flanges 16, and iris discs 20, 22 and 24 remain intact to form the waveguide filter 10. The plasma spray formed layer forms the hollow body of the filter and the plated metal layer forms a high conductivity liner on the inner surfaces of the body and coupling flanges. This liner is integrally joined to the edges of the iris discs and to the metal plating on the discs and the seating faces of the coupling flanges to provide good electrical continuity between the liner and the disc and flange plating. As noted earlier, the iris discs from the resonant filter cavities. Removal of the threaded studs 44 with the mandrel leaves in the filter body the metal plated, threaded tuning screw holes 36. The metal plating in these holes is integrally joined to the liner to provide good electrical continuity therebetween.

The mandrel may be removed in various ways. According to the preferred practice of the invention, the mandrel and its threaded studs are constructed of a material, such as aluminum, which may be selectively etched away from the plasma spray formed filter body and its conductive liner and coupling flanges by immersion of the parts in a suitable chemical agent, as depicted in step 11 of FIG. 2. Alternatively, the mandrel may be constructed of a low melting point material, such as wax, and removed by melting the mandrel. Any other suitable mandrel removal procedure may be employed.

Following removal of the mandrel, the resulting filter structure may be plated with a thin layer of gold, after which the tuning screws 38 are inserted in the filter and the latter is subjected to final inspection, as indicated in steps 12 and 13 of FIG. 2.

As noted earlier, while the invention has been described in connection with a waveguide filter, it may be utilized to fabricate other waveguide structures, such as simple waveguides.

We claim:

1. The method of fabricating a waveguide structure comprising the steps of:

selecting a mandrel having a transverse cross-section conforming to the desired internal cross-section of said structure, a relatively smooth circumferential surface and at least one threaded stud projecting radially beyond said mandrel surface;

plating said mandrel, including each stud, with a metal of relatively high electrical conductivity to form on said mandrel surface a relatively thin and uniform layer of said metal having an inner surface conforming to said mandrel surface and on the threads of each stud a layer of said metal integrally joined to said mandrel surface metal layer;

plasma spray coating the plated mandrel, including each plated stud, with a selected material to form a relatively thick layer of said material over and bonded to said metal layers; and removing said mandrel, including each stud, to form a microwave structure wherein said material layer forms the body of the structure, said mandrel surface metal layer forms a high conductivity liner within said body, and said body contains a threaded radial hole corresponding to each stud and having an internal metal layer integrally joined to said mandrel surface layer for receiving a tuning screw.

2. The method of claim 1 including the additional step of:

machining the exterior of said body to provide a circumferential reinforcing rib about the body containing each said threaded hole and relatively thin body wall portions at opposite sides of each rib.

3. The method of claim 2 wherein: said body is machined prior to removal of said mandrel.

4. The method of fabricating a waveguide structure comprising the steps of:

selecting a mandrel having a transverse cross-section conforming to the desired internal cross-section of said structure and a relatively smooth circumferential surface;

plating said mandrel with a metal of relatively high electrical conductivity to form on said mandrel surface a relatively thin and uniform layer of said metal having an inner surface conforming to said mandrel surface;

plasma spray coating the plated mandrel with a selected material to form a relatively thick layer of said material over and bonded to said metal layer;

preparing rings which are internally sized to fit snugly over the plated mandrel, placing said rings over the plated mandrel adjacent the ends of said material layer, joining said rings to said latter layer by plasma spray coating said rings and latter layer with said material, and plating the axially presented faces of said rings with said metal to form on said ring faces layers of said metal integrally joined to said metal layer on said mandrel; and removing said mandrel to form a microwave structure wherein said material layer forms the body of the structure, said rings form coupling flanges at the ends of said body, and said metal layer forms a high conductivity liner within said body.

5. The method of fabricating a waveguide filter comprising the steps of:

selecting a mandrel having a transverse cross-section conforming to the desired internal cross-section of the structure and comprising at least two separable sections arranged end to end, said sections having confronting ends in planes normal to the mandrel axis and relatively smooth circumferential surfaces;

selecting an apertured iris disc conforming to the mandrel cross-section for each pair of adjacent mandrel sections;

confining an iris disc between the ends of and in coaxial relation to each pair of adjacent sections;

plating said mandrel sections and the edge of each iris disc with a metal of relatively high electrical conductivity to form on said mandrel surfaces and the edge of each iris disc a relatively thin and uniform layer of said metal bonded to each iris disc edge and having inner surfaces conforming to said mandrel surfaces;

plasma spray coating said metal layer with a selected material to form a relatively thick layer of said material over and bonded to said metal layer; and removing said mandrel sections to form a waveguide filter wherein said material layer forms the body of the filter and said metal layer forms a high conductivity liner within said body and integrally bonded to each iris disc.

6. The method of claim 5 including the additional step of:

plating each iris disc with said metal prior to confinement of the iris disc between said mandrel sections.

7. The method of claim 5 wherein:

certain of said mandrel sections include threaded studs projecting radially beyond said mandrel surfaces which are plated with said metal, plasma spray coated with said material, and removed with said mandrel sections to form in said body threaded radial holes having an internal metal plating layer integrally joined to said body liner for receiving tuning screws.

8. The method of claim 7 including the additional step of:

machining the exterior of said body to provide circumferential reinforcing ribs about the body containing said holes and relatively thin wall body wall portions at opposite sides of the ribs.

9. The method of claim 8 wherein:

said body is machined prior to removal of said mandrel.

10. The method of claim 9 including the additional step of:

forming on the ends of said body prior to removal of said mandrel coupling flanges having axially presented seating faces bearing layers of said metal integrally joined to said body liner.

11. The method of claim 10 wherein:

said coupling flanges are formed by preparing rings which are internally sized to fit snugly over the plated mandrel, placing said rings over the plated mandrel adjacent the ends of said body, plasma spray coating said rings and body to join said rings and body, and plating the axially presented faces of said rings with said metal to form on said ring faces layers of said metal integrally joined to said metal layer on said mandrel.

12. The method of claim 5 wherein:

said body material is a relatively low thermal expansion material.

13. The method of claim 5 wherein:

said mandrel is constructed of a material which is soluble in a solution in which said liner metal and body material are insoluble; and said mandrel is removed by selectively etching the mandrel away with said solution.

14. The method of claim 5 wherein:

said mandrel is constructed of a material having a relatively low melting point compared to said liner metal and body material; and said mandrel is removed by melting the mandrel.

* * * * *